United States Patent [19]

Suzuki

[11] Patent Number: 4,686,731

[45] Date of Patent: Aug. 18, 1987

[54] FABRIC CURRYCOMB

[76] Inventor: Nobuhiko Suzuki, 2114-18, Tomitsuka-cho, Hamamatsu City, Shizuoka Prefecture, Japan

[21] Appl. No.: 633,658

[22] Filed: Jul. 23, 1984

[51] Int. Cl.[4] ..... A47L 25/08

[52] U.S. Cl. ..... 15/104 A; 15/105; 132/76.4

[58] Field of Search ..... 132/1 R, 9, 76.4, 88.7; 401/139, 202; 15/1, 1.5 R, 1.5 A, 104 R, 104 A, 105; D4/23.1

[56] References Cited

U.S. PATENT DOCUMENTS

| | | | |
|---|---|---|---|
| 59,118 | 10/1866 | Arnold | 132/32 A |
| 1,373,970 | 4/1921 | Peasley | 132/76.4 |
| 2,708,761 | 5/1955 | Bergquist | 15/104 A |
| 2,735,434 | 2/1956 | DeRossett | 132/76.4 |
| 2,760,217 | 8/1956 | McKenzie | 15/105 |
| 3,040,352 | 6/1962 | Vian | 15/104 A |
| 3,056,154 | 10/1962 | Neal | 15/104 A |
| 3,321,790 | 5/1967 | Hand | 15/104 A |
| 3,330,077 | 7/1967 | Kanbar et al. | 15/104 A |
| 3,336,616 | 8/1967 | Martin | 15/104 A |
| 3,389,416 | 6/1968 | Timms | 15/104 A |
| 3,906,578 | 9/1975 | Huber | 15/104 A |

*Primary Examiner*—Robert P. Swiatek
*Assistant Examiner*—Carolyn A. Harrison

[57] ABSTRACT

A fabric currycomb or fuzz comb comprises a substantially flat handle base plate having a plurality of straight edges and a plurality of abrasive net strips of different abrasive capabilities supported on the straight edges, respectively, and having a multiplicity of small projections in a file pattern.

1 Claim, 5 Drawing Figures

FABRIC CURRYCOMB

BACKGROUND OF THE INVENTION

The present invention relates to a fabric currycomb or fuzz comb having strips of abrasive net with a multiplicity of small projections arranged in a file pattern.

FIGS. 1 and 2 of the accompanying drawings show a conventional fabric currycomb. The illustrated conventional fabric currycomb is composed of a substantially flat base plate doubling as a handle and having a recess defined in and along a single straight edge. The recess includes a channel-shaped groove defined in an inner bottom surface. The fabric currycomb also includes a strip of abrasive net folded into a U shape over a spacer or slide core and inserted in the channel-shaped groove, the strip of abrasive net being bonded to the base plate with an adhesive. Since the prior fabric currycomb has only one strip of net, it fails to cope with all conditions of fabric fuzz or fluff to be removed. The U-shaped net strip has a lower edge lying substantially flush with the straight edge of the base plate. However, the other surfaces of the net strip are recessed into the recess below the surfaces of the base plate. Accordingly, only the lower edge of the net strip is available for removing the fabric fuzz and no other net surfaces are effective in fubric fluff removal. For this reason, the conventional fabric currycomb has been highly poor in efficiency.

SUMMARY OF THE INVENTION

It is an object of the present invention to provide a fabric currycomb which will eliminate the problem experienced with the conventional fabric currycomb.

Another object of the present invention is to provide a fabric currycomb capable of removing different types of fabric fuzz or fluff.

Still another object of the present invention is to provide a fabric currycomb which can be used easily.

A still further object of the present invention is to provide a fabric currycomb which can remove fabric fuzz or fluff highly efficiently.

According to the present invention, a fabric currycomb comprises a substantially flat handle base plate having a plurality of straight edges and a plurality of abrasive net strips of different abrasive capabilities supported on the straight edges, respectively, and having a multiplicity of small projections in a file pattern.

The straight edges each carrying the abrasive net strip or hypothetical extensions thereof are arranged not to form a closed area, i.e. a polygon. In other words at least one side of the polygon is not provided with the abrasive net strip.

The base plate has grooves defined in opposite surfaces thereof adjacent to the straight edges and extending substantially parallel thereto, each of the net strips being folded into a substantially U or V cross-sectional shape and having free marginal edges bent and inserted into the grooves adjacent to one of the straight edges.

The above and other objects, features and advantages of the present invention will become more apparent from the following description when taken in conjunction with the accompanying drawings in which preferred embodiments of the present invention are shown by way of illustrative example.

DESCRIPTION OF THE PREFERRED EMBODIMENTS

Figure 1:
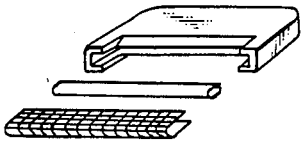
FIG. 1 is an exploded perspective view of a conventional fabric currycomb.
Figure 2:
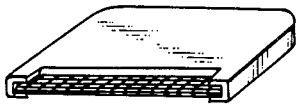
FIG. 2 is a perspective view of the conventional fabric currycomb as assembled.
Figure 3:
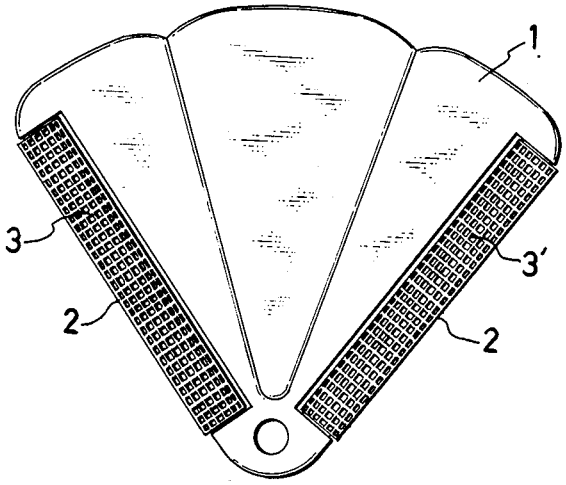
FIG. 3 is a plan view of a fabric currycomb according to the present invention.

As shown in FIG. 3, a fabric currycomb or fuzz comb is composed of a substantially flat sectorial base plate 1 doubling as a handle and has two straight edges 2, 2 supporting thereon respective strips 3, 3' of abrasive net having a multiplicity of small projections in a file pattern and having different abrasive properties.

Figure 4:
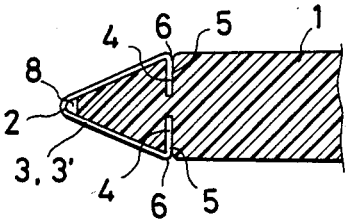
FIG. 4 is a fragmentary cross-sectional view of a net attachment in the fabric currycomb, according to a first embodiment of the present invention.

According to a first embodiment as shown in FIG. 4, each of the net strips 3, 3' is folded into a V shape and includes upper and lower marginal edges bent inwardly toward each other as inserts 4, 4. The base plate 1 has upper and lower grooves 5, 5 defined in upper and lower surfaces thereof and extending along each of the straight edges 2. The inserts 4, 4 of each net strip 3, 3' are fitted respectively in the grooves 5, 5, leaving exposed edges 6, 6. The net strips 3, 3' are bonded to the base plate 1 at the inserts 4, 4.

Figure 5:
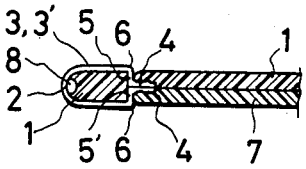
FIG. 5 is a fragmentary cross-sectional view of a net attachment in the fabric currycomb, according to a second embodiment of the present invention.

FIG. 5 shows a second embodiment in which each of the net strips 3, 3' is folded into a U shape and has upper and lower marginal edges bent inwardly toward each other into inserts 4, 4, leaving exposed edges 6, 6. The fabric currycomb shown in FIG. 5 has a base plate 1 and a cover 7 attached thereto, the base plate 1 and the cover 7 having grooves 5, 5' extending along each of straight edges 2. The inserts 4, 4 are inserted respectively in the grooves 5, 5' and bent between the base plate 1 and the cover 7. The net strips 3, 3' are secured in position with inserts 4, 4 held between the base plate 1 and the cover 7. The groove 5' is formed between the base plate 1 and the cover 7 when they are assembled together. The groove 5' is defined by fitting one edge of the net strip 3 or 3' in the groove 5, wrapping the edge of the base plate 1 with the net strip, pressing the other edge of the net strip below the cover 7, and then fixing the cover 7 to the base plate 1.

As shown in FIGS. 4 and 5, each of the straight edges 2, 2 of the base plate 1 has a recess 8 providing a space or gap between the net strip 3 or 3' and the straight edge.

The fabric currycomb thus constructed will be used as follows: The base plate 1 is gripped by the user at the arcuate edge other than the straight edges 2, 2, and one flat side surface of one of the V-shaped or U-shaped net strip 3 or 3' is held against a fabric of a garment placed on a table or another solid base. Then, the fabric currycomb is pulled by the user against the garment fabric to remove fabric fuzz or fluff. The net strips 3, 3' having different abrasive capabilities are selectively used dependent on the kind of fabric fuzz to be removed. Fuzz of relatively large sizes can be removed by being scratched by the V-shaped or U shaped bent edge of the net strip 3 or 3'.

The fabric currycomb of the invention is advantageous as follows: The different net strips 3, 3' can selectively be used to cope with different fabric types and for effectively removing different kinds of fuzz to be removed. Therefore, the fabric currycomb is highly effective in fuzz removal and finds wider use. Since the net strips are supported on the straight edges 2, 2 only with no net strip on the arcuate edge of the base plate, and the straight edges 2, 2 each carrying the abrasive net strip area, i.e. a polygon, the user's hand will not be injured by the net strip which is in no use as it is placed in the palm of the hand. The fuzz can highly effectively be removed when one flat side surface of the net strip 3 or 3' is held and pulled against the fabric. The exposed edge 6 also serves to scrape off the fuzz effectively. The space 8 defined in the straight edge 2 can trap the fuzz between the base plate 1 and the net strip 3 for reliable removal.

In case of conventional fabric currycomb which would require slide cores in a mold for fabrication, it would be highly difficult to fabricate the fabric currycomb in which a plurality of net strips 3 are to be attached to a plurality of edges of a base plate 1 of plastic material of a shape whose edges do not face toward directions represented by a same line. Especially, it would be difficult to fabricate base plates in a mold for molding a number of products at a time. Because, more specifically, the slide cores would usually be movable in one direction only in a mold. With the present invention, no slide core is used, and hence it is possible to attach a plurality of net strips in any direction. Therefore, the fabric currycomb of the invention can be manufactured more advantageously.

Therefore, the fabric currycomb of the invention is more advantageous from the standpoints of use and manufacture than conventional fabric currycombs in that it is easy to use and can effectively remove different kinds of fuzz or fluff from rugs, garments, and other fabric pieces.

Although certain preferred embodiments have been shown and described, it should be understood that many changes and modifications may be made therein without departing from the scope of the appended claims.

What is claimed is:

1. A fabric currycomb comprising a substantially flat handle base plate having a plurality of straight edges representing sides of a geometrical figure and having grooves defined in opposite surfaces thereof adjacent to said straight edges and extending substantially parallel thereto; and a plurality of abrasive net strips of different abrasive capabilities supported on said straight edges, respectively, and having a multiplicity of small projections in a file pattern, and each of said net strips being folded into a substantially U or V cross-sectional shape and having free marginal edges bent and inserted into said groove adjacent to one of said straight edges.

* * * * *